US006474246B2

(12) United States Patent
Hsu

(10) Patent No.: US 6,474,246 B2
(45) Date of Patent: Nov. 5, 2002

(54) TABLE WITH EXTENDABLE LEGS

(76) Inventor: Hsiu-Ching Hsu, No. 28, Alley 6, Lane 106, Chung-Ching Rd., Pei-Tun Dist., Taichung (TW)

( * ) Notice: Subject to any disclaimer, the term of this patent is extended or adjusted under 35 U.S.C. 154(b) by 0 days.

(21) Appl. No.: 09/781,669

(22) Filed: Feb. 12, 2001

(65) Prior Publication Data

US 2002/0108544 A1 Aug. 15, 2002

(51) Int. Cl.[7] ..... A47B 9/00
(52) U.S. Cl. ..... 108/147
(58) Field of Search ..... 108/147, 144.11, 108/147.19; 248/161, 404, 422, 405, 188.4

(56) References Cited

U.S. PATENT DOCUMENTS 228,518 A * 6/1880 Dawes
2,249,455 A * 7/1941 Caldwell
3,938,820 A * 2/1976 Nabinger
4,604,955 A * 8/1986 Fleischer et al. ..... 108/147
4,627,364 A * 12/1986 Klein et al. ..... 108/147
5,447,099 A * 9/1995 Adams et al. ..... 108/147
5,890,438 A * 4/1999 Frankish ..... 108/147
5,941,182 A * 8/1999 Greene ..... 108/147
6,024,025 A * 2/2000 Koch et al. ..... 108/147
6,263,809 B1 * 7/2001 Wolters ..... 108/147

FOREIGN PATENT DOCUMENTS

DE 0208546 * 4/1984 ..... 108/147
DE 3303193 A1 * 8/1984

* cited by examiner

*Primary Examiner*—Jose V. Chen
(74) *Attorney, Agent, or Firm*—Alan Kamrath; Rider, Bennett, Egan & Arundel, LLP

(57) ABSTRACT

A table with extendable legs includes at least one base and extendable leg having one end secured in the base so the leg can stand upright. A tabletop is mounted horizontally on the other end of the leg. The leg includes an external rod and a sleeve centrally inserted into and secured in the hollow external rod. The sleeve includes an inner thread formed in a free end of the sleeve. A hollow internal rod is movably received in the hollow external rod. A threaded spindle is screwed into inner thread and a first gear is securely attached to the free end of the threaded spindle. A Z-shaped handle includes one end having a second gear securely mounted to engage to the first gear to drive the threaded spindle to control the length of the extendable leg to control the height of the table.

18 Claims, 6 Drawing Sheets

TABLE WITH EXTENDABLE LEGS

BACKGROUND OF THE INVENTION

1. Field of the Invention

The present invention relates to a table, and more particularly to a table with legs that can extend-to a suitable length to accommodate a specific user's stature.

2. Description of Related Art

A conventional table, such as a computer table, a desk, a drawing table or the like in accordance with the prior art comprises a tabletop and multiple legs mounted on the bottom of the tabletop to support the tabletop at affixed height. The legs of the conventional table are fixed so that the height of the tabletop cannot be adjusted to suit different users. For example, a short user using a tall computer table must lift his hands all the time when keying in data. This position easily fatigues a user especially his or her wrists and shoulders.

The present invention has arisen to mitigate and/or obviate the disadvantages of the conventional table.

SUMMARY OF THE INVENTION

The main objective of the present invention is to provide an improved table that has extendable legs that can adjust the height of the table to suit different users whether tall or short. The table with extendable legs in accordance with the present invention comprises at least one leg mounted in a base to stand up right, a frame mounted on the leg and a tabletop attached to the frame. In the preferred embodiment of the present invention, the table has two legs. Each leg includes a hollow external rod with one end secured in the base and a hollow internal rod movably mounted in the external rod from the other end of the external rod. A sleeve is centrally mounted in the external rod and extends into the internal rod an inner thread is formed in the free end of the sleeve. A connector is secured on the top of the internal rod to mount a frame to support a tabletop. A first gear is rotatably mounted in the connector and a threaded spindle is securely attached to the center of the first gear. The threaded spindle is screwed into the inner thread in the sleeve. The frame includes two rods each mounted on a connector and having a U-shaped section. A tube is mounted between the two rods and connects the internal surfaces of the two rods. A shaft is rotatably mounted in the tube, and one end extends through the rod and has a handle mounted on the end. Two second gears are respectively secured in opposite ends of the shaft and engage the first gear to drive the threaded spindle to adjust the height of the table in accordance with the present invention.

Further benefits and advantages of the present invention will become apparent after a careful reading of the detailed description with appropriate reference to the accompanying drawings.

DETAILED DESCRIPTION OF THE INVENTION

Figure 1:
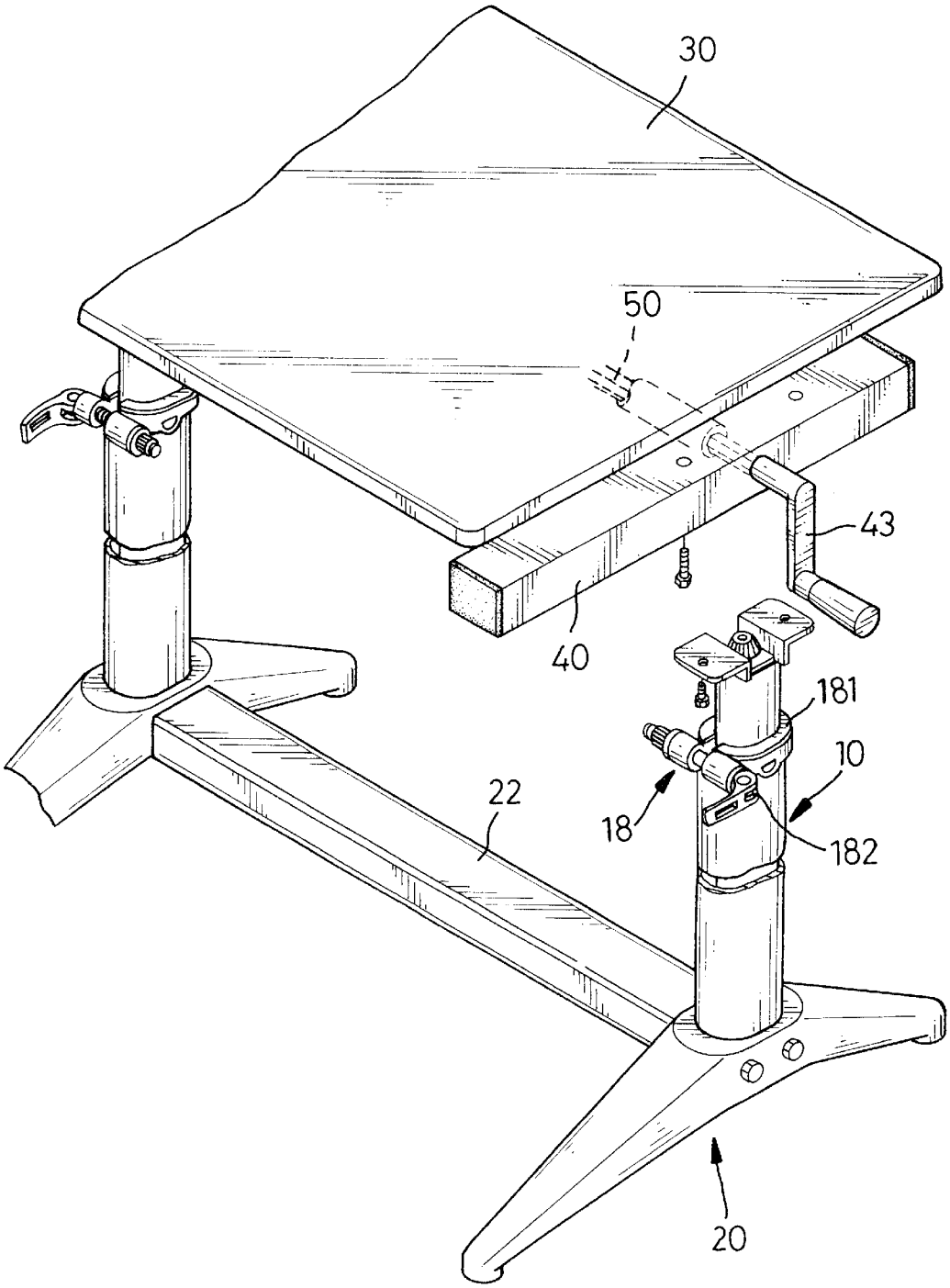
FIG. 1 is an exploded perspective view of a table with extendable legs in accordance with the present invention.

With reference-to the drawings and initially to FIG. 1, a table with extendable legs in accordance with the present invention comprises at least one leg (10), a base (20), a frame (40) and a tabletop (30). The leg (10) with-one end mounted in a base (20) stands up right. The frame (40) is mounted on the other end of the leg (10) to support the tabletop (30). The leg (10), base (20), frame (40) and tabletop (30) can be detached from one another to save space during transportation or storage.

With reference to FIGS. 1–4, the preferred embodiment of the table with extendable legs in accordance with the present invention comprises two legs (10) with a base (20) corresponding to each leg (10) and a horizontal stabilizer (22) connected between the two bases (20) to promote the rigidity and stability of the table. The leg (10) includes a hollow external rod (11) having a closed end secured in the base (20) and an open-end opposite to the closed end. A sleeve (13) is centrally secured in the external rod (11) and has an internal thread (131) formed in the free end of the sleeve (13). The internal thread (13l) has a diameter smaller than the internal diameter of the sleeve (13).

A hollow internal rod (12) is movably received in the external rod (11) and has one end extending out from the external rod (11). A connector (121) is mounted in the end of the internal rod (12) extending out from the external rod (11), and a first gear (15) is rotatably mounted in the connector (121). The first gear (15) may be a bevel gear. A first end of a threaded spindle (151) is centrally rotatably mounted in the connector (121), and a second end extends into the internal rod (12). The threaded spindle (151) is screwed into the inner thread (131) in the sleeve (13) to hold the internal rod (12) in place. A collar (16) is attached to the free end of the external rod (11) and abuts the external periphery of the internal rod (12). An annular bushing (17) is attached to the outside of the end of the internal rod (12) opposite to the connector (121) and slides on the internal surface of the external rod (11). The collar (16) and the annular bushing (17) can prevent the internal surface of the external rod (11) from being damaged by the internal rod (12) and promotes the stability between the external rod (11) and the internal rod (12).

Figure 5:
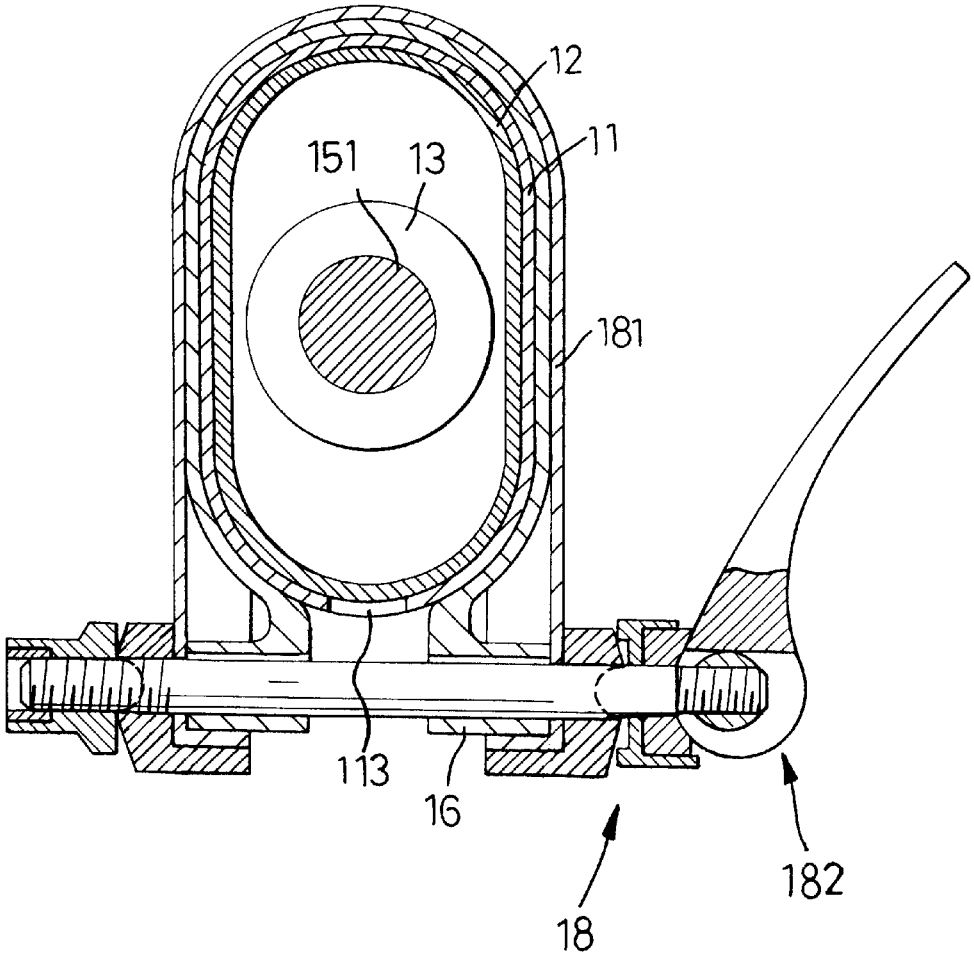
FIG. 5 is a cross sectional top plan view of the leg of the table along line 5—5 in FIG. 4.
Figure 6:
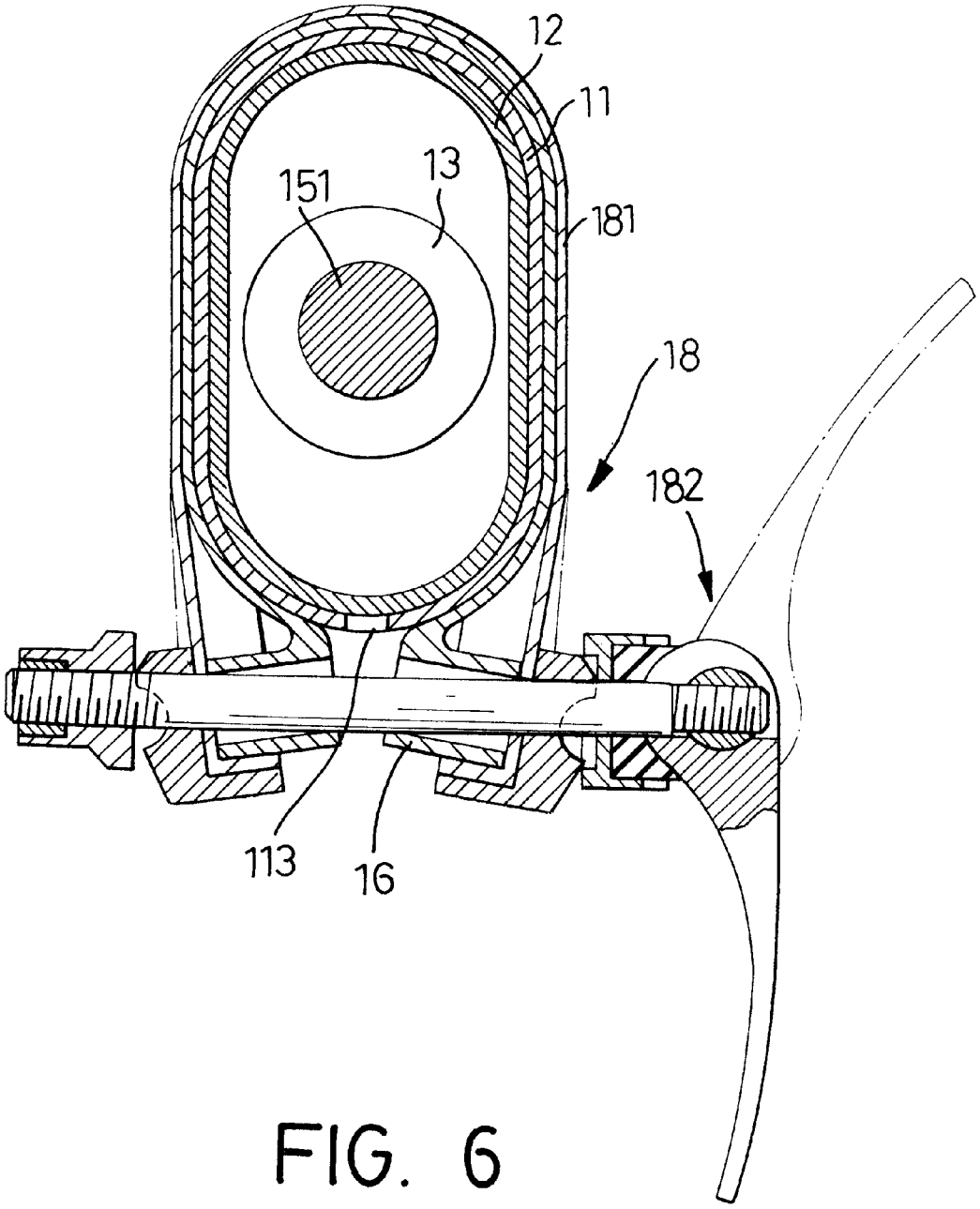
FIG. 6 is an operational cross sectional top plan view of the leg of the table along line 5—5 in FIG. 4

Further with reference to FIGS. 5 and 6, a groove (113) is longitudinally defined in the free end of the external rod (11) and a clamp (18) is mounted around the free end of the external rod (11). The free end of the external, rod (11) is squeezed by the clamp (18) and the groove (113) narrows and securely grips the internal rod (12) when the internal rod (12) extends to a suitable height. The clamp (18) includes a C-shaped clamp (181) with an ear formed in each end through which a quick release lever (182) is mounted to operate the clamp (18). The external rod(11) includes multiple slots (112) defined in the free end of the external rod (11). The clamp (181) has multiple latches (183) extending inwardly to insert into the corresponding slots (112) of the external rod (11) to hold the clamping device (18) in place when the quick release lever (182) is released.

Figure 2:
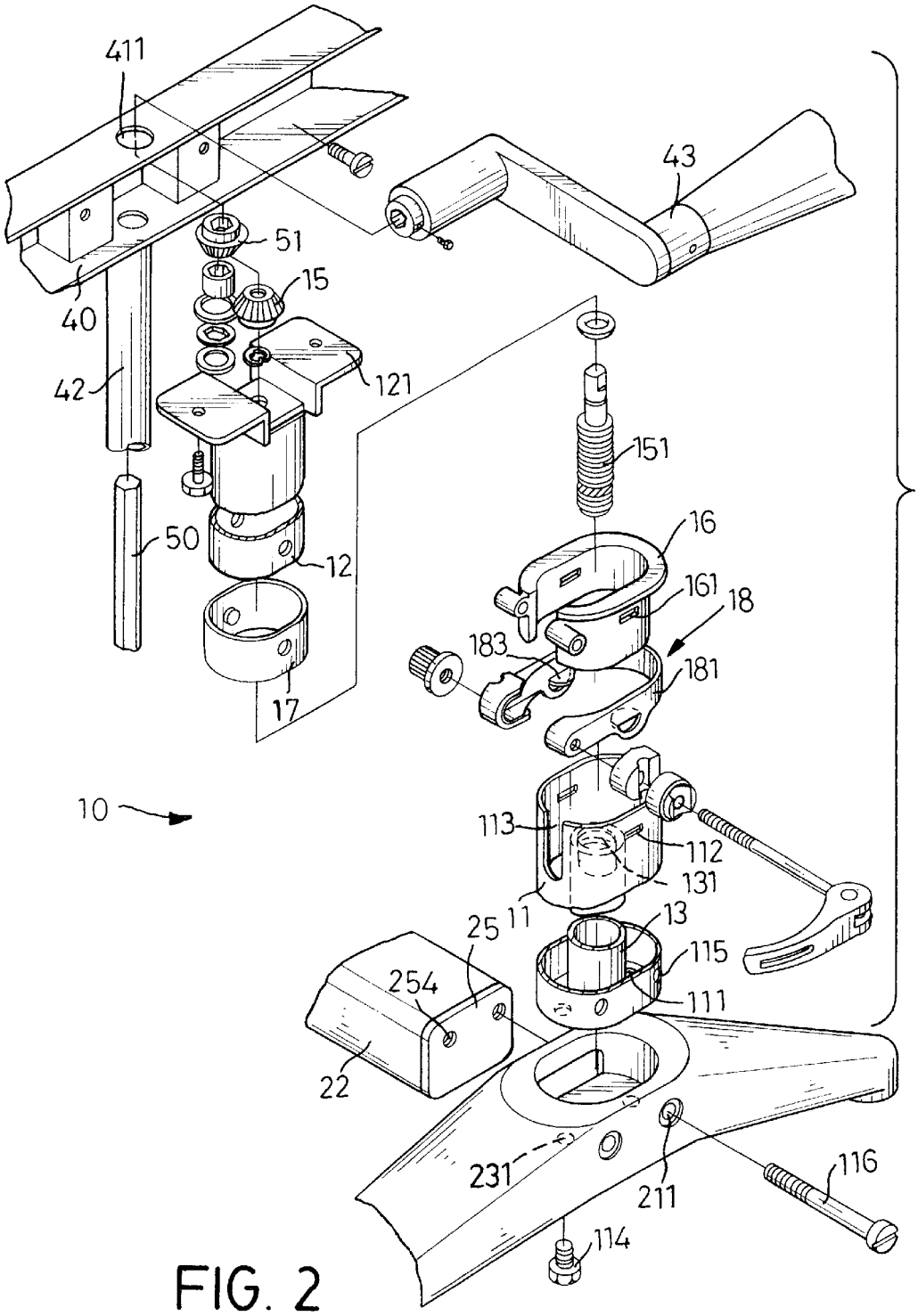
FIG. 2 is a partial exploded perspective view of the table with extendable legs in FIG. 1.
Figure 3:
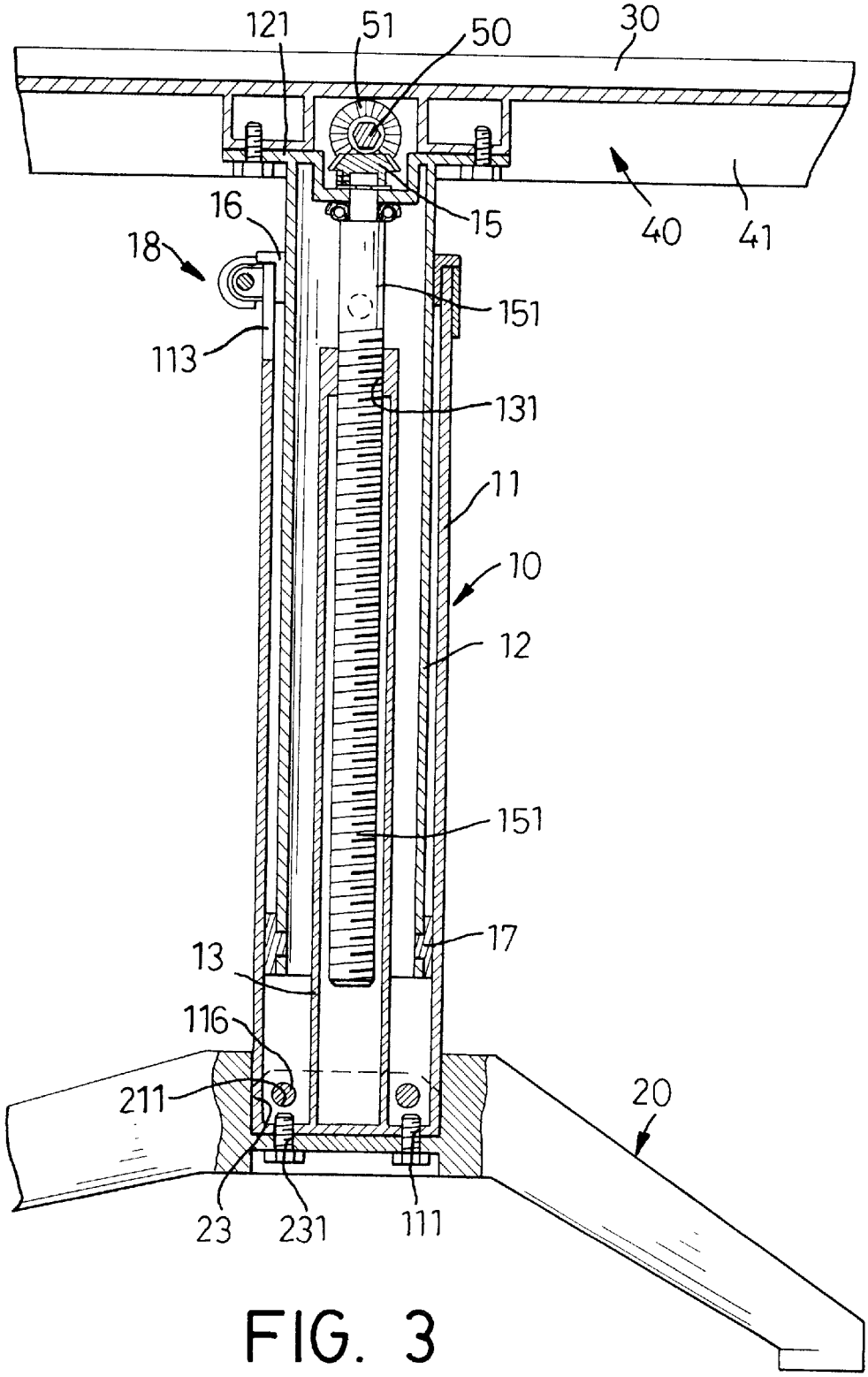
FIG. 3 is a cross sectional side plan view of a leg of the table with extendable legs in FIG. 1.
Figure 4:
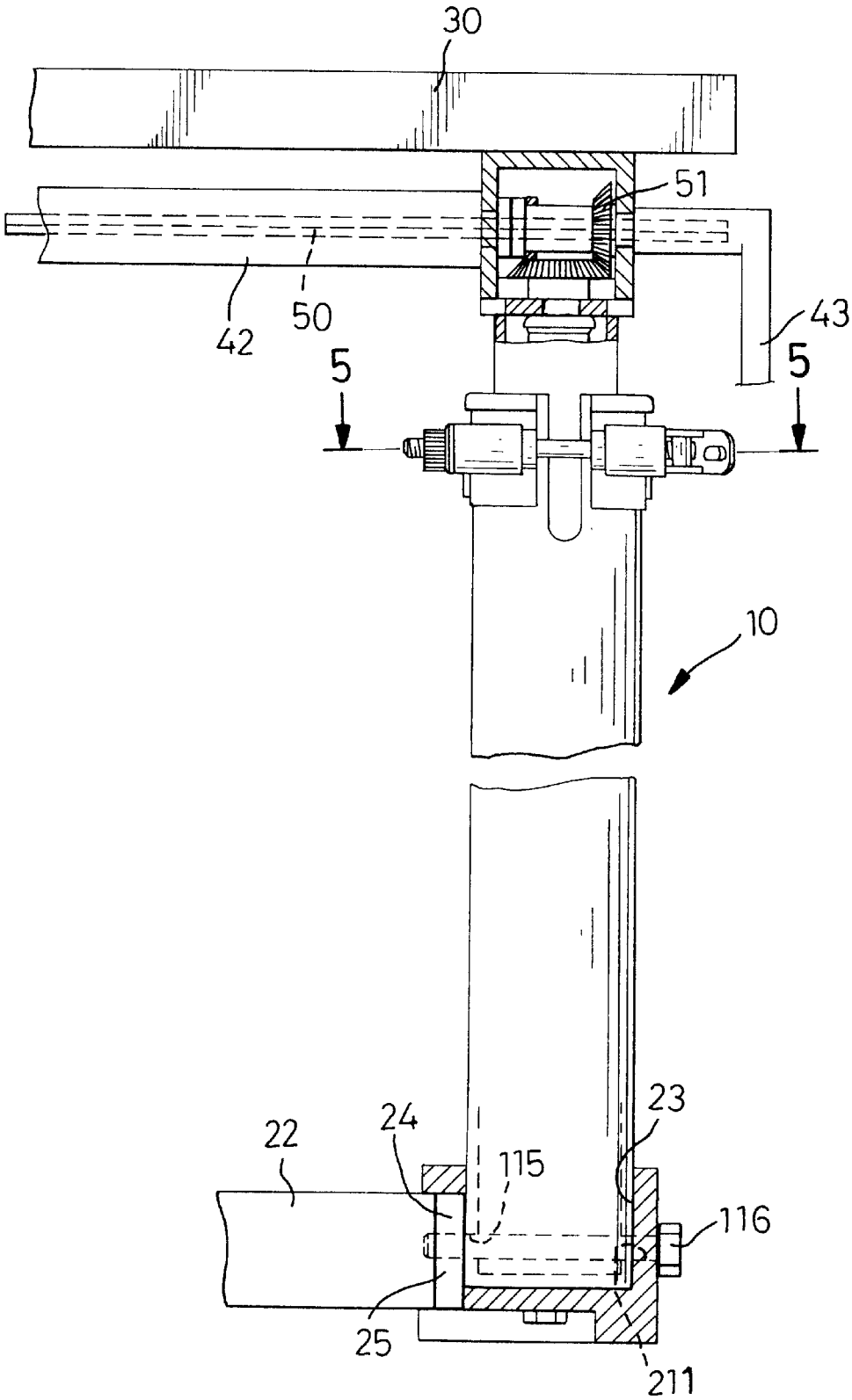
FIG. 4 is a partial front plan view in partial section of the table with extendable legs in FIG. 1.

With reference to FIG. 2, 3 and 4, the base (20) includes a recess (23) defined in the top portion to receive the closed end of the external rod (11). The external rod (11) includes a bottom formed on the close end and has multiple threaded holes (111) defined in the bottom of the external rod (11). Multiple through holes (115) are defined in the external rod (11) and extends through the external rod (11) near the closed end. The recess (23) in the base (20) includes a bottom having multiple bores (231) defined to correspond to the threaded holes (111) in the external rod (11) and extend through the base (20). A first bolt (114) extends through the bore (231) in the bottom of the recess (23) and is screwed into the threaded hole (111) of the external rod (111)to secure the external rod (11) in the base (20). Two end caps (25) are respectively attached to opposite ends of the horizontal stabilizer (22), and each has multiple threaded holes (254) defined to correspond to the through holes (115) in the external rod (11) The base (20) includes two sidewalls. One sidewall faces the other base (20) and has a cutout (24) defined to receive one end of the horizontal stabilizer (22). The other sidewall of the base (20) has multiple holes (211) defined to correspond to the through hole (115) in the external rod (11). A second bolt (116) extends through the hole (211) in the base (20) and the through hole (115) in the external rod (11) and is screwed into the threaded hole (254) in the end cap (25) to secure the horizontal stabilizer (22) to the base (20).

The frame (40) includes two rods (41) each with an inverted U-shaped cross section respectively attached to the connector (121) and a tube (42) mounted between the two rods (41) to communicate with the internal peripheries of the two rods (41). A through hole (411) is laterally defined in the rod (41) to allow a polygonal shaft (50) to extend through the tube (42) and into the other rod (41). The shaft (50) is rotatably received in the tube (42). One end of the shaft (50) extends through the tube (41) and has a Z-shaped handle (43) with an end having a recess defined to securely receive the end of the actuated shaft (50). A second gear (51) is mounted around each end of the shaft (50) and engages with the first gear (15). The second gear (51) may be a bevel gear. Consequently, the first gear (15) and the threaded spindle (151) are rotated by the second gear (51) when the user turns the shaft (50) with the handle (43).

By rotating the threaded spindle (151), the height of the table is adjusted up or down to suit each user's purpose. The two gears (15, 51) drive the threaded spindle (151) so that the height of the table can be adjusted to any height. Furthermore, the main components of the table such as the leg (10), the base (20) and the tabletop (30) can be easily detached from one another so that the space taken up by the table in accordance with the present invention is smaller than that of the conventional table when stored.

Although the invention has been explained in relation to its preferred embodiment, it is to be understood that many other possible modifications and variations can be made without departing from the spirit and scope of the invention as hereinafter claimed.

What is claimed is:

1. A table with extendable legs comprising:

at least one base;

at least one leg including a first end mounted in a corresponding one of the at least one base to stand upright and a second end, the leg comprising:

a hollow external rod having a closed end mounted in the base and an open end opposite to the base;

a sleeve centrally inserted into and secured in the hollow external rod, the sleeve including an internal thread formed in a free end of the sleeve, the internal thread having a diameter smaller than the internal diameter of the sleeve;

a hollow internal rod movably received in the hollow external rod;

a connector attached to one end of the hollow internal rod opposite to the base;

a threaded spindle having a first end screwed into the sleeve via the internal thread in the sleeve and a second end rotatably mounted in the connector and extending through the connector; and a first gear securely attached to the second end of the threaded spindle;

a frame including at least one rod mounted on a corresponding one of the connectors;

a handle including one and extending into one of the at least one rod and having a second gear securely mounted on an extension formed on the handle to engage with the first gear to drive the threaded spindle; and a tabletop mounted on the frame.

2. The table with extendable legs as claimed in claim 1, wherein the leg comprises a collar attached to the free end of the external rod-and abutting the external surface of the internal rod, and an annular bushing attached to one end of the internal rod opposite to the connector and abutting an internal surface of the external rod.

3. The table with extendable legs as claimed in claim 2, wherein the base comprises a top portion having a recess defined in the top portion of the base to receive the closed end of the external rod, the recess having a bottom with multiple bores defined through the bottom and the external rod having a bottom formed on the closed end, multiple threaded holes defined in the bottom of the external rod and corresponding to the bores in the recess, a first bolt extending through each bore in the recess and screwed into the corresponding threaded hole in the external rod to secure the external rod in the base.

4. The table with extendable legs as claimed in claim 3, wherein the external rod has a groove longitudinally defined in the free end of the external rod and the leg comprises a clamp mounted around the free end of the external rod to narrow the groove to securely hold the internal rod in place.

5. The table with extendable legs as claimed in claim 4, wherein the clamp comprises a C-shaped clamp with an ear formed on each end for mounting a quick release lever to operate the clamp.

6. The table with extendable legs as claimed in claim 5, wherein the external rod comprises multiple slots defined in the free end and the C-shaped clamp comprises multiple latches extending inward to insert into the slots to prevent the clamp from detaching from the free end of the external rod when the clamp is released.

7. The table with extendable legs as claimed in claim 2, wherein the external rod has a groove longitudinally defined in the free end of the external rod and the leg comprises a clamp mounted around the free end of the external rod to narrow the groove to securely hold the internal rod in place.

8. The table with extendable legs as claimed in claim 7, wherein the clamp comprises a C-shaped clamp with an ear formed on each end for mounting a quick release lever to operate the clamp.

9. The table with extendable legs as claimed in claim 8, wherein the external rod comprises multiple slots defined in the free end and the C-shaped clamp comprises multiple latches extending inward to insert into the slots to prevent the clamp from detaching from the free end of the external rod when the clamp is released.

10. The table with extendable legs as claimed in claim 1, wherein the base comprises a top portion having a recess defined in the top portion of the base to receive the closed end of the external rod, the recess having a bottom with multiple bores defined through the bottom and the external rod having a bottom formed on the closed end, multiple threaded holes defined in the bottom of the external rod and corresponding to the bores in the recess, a first bolt extending through each bore in the recess and screwed into the corresponding threaded hole in the external rod to secure the external rod in the base.

11. The table with extendable legs as claimed in claim 10, wherein the external rod has a groove longitudinally defined in the free end of the external rod and the leg comprises a clamp mounted around the free end of the external rod to narrow the groove to securely hold the internal rod in place.

12. The table with extendable legs as claimed in claim 11, wherein the clamp comprises a C-shaped clamp with an ear formed on each end for mounting a quick release lever to operate the clamp.

13. The table with extendable legs as claimed in claim 12, wherein the external rod comprises multiple slots defined in the free end and the C-shaped clamp comprises multiple latches extending inward to insert into the slots to prevent the clamp from detaching from the free end of the external rod when the clamp is released.

14. The table with extendable legs as claimed in claim 1, wherein the external rod has a groove longitudinally defined in the free end of the external rod and the leg comprises a clamp mounted around the free end of the external rod to narrow the groove to securely hold the internal rod in place.

15. The table with extendable legs as claimed in claim 14, wherein the clamp comprises a C-shaped clamp with an ear formed on each end for mounting a quick release lever to operate the clamp.

16. The table with extendable legs as claimed in claim 15, wherein the external rod comprises multiple slots defined in the free end and the C-shaped clamp comprises multiple latches extending inward to insert into the slots to prevent the clamp from detaching from the free end of the external rod when the clamp is released.

17. A table with extendable legs comprising:

two bases;

a horizontal stabilizer having two opposite ends respectively secured in a corresponding one of the two bases;

two legs each including a first end mounted in a corresponding one of the base to stand upright, each of the legs comprising:

a hollow external rod having a closed end mounted in the base and an open end opposite to the base;

a sleeve centrally inserted into and secured in the hollow external rod, the sleeve including an internal thread formed in a free end of the sleeve, the internal thread having a diameter smaller than the internal diameter of the sleeve;

a hollow internal rod movably received in the hollow external rod;

a connector attached to one end of the hollow internal rod opposite to the base;

a threaded spindle having a first end screwed into the sleeve via the internal thread in the sleeve and a second end rotatably mounted in the connector and extending through the connector; and a first gear securely attached to the second end of the threaded spindle;

two rods each having an invaded U-shaped cross section respectively mounted on a corresponding one of the connectors;

a tube axially aligned with the first gears and mounted between the two rods with inverted U-shaped cross section, the tube connecting the internal surfaces of the two rods with inverted U-shaped cross section; and a shaft ratably received in the tube, the shaft including two ends each having a second gear engaged to and driving the first gears of the legs; and a Z-shaped handle having one end extending into one of the rods with inverted U-shaped cross section and secured on and driving a corresponding one of the second gears.

18. The table with extendable legs as claimed in claim 17, wherein a cutout is defined in each of the two bases to receive opposite ends of the horizontal stabilizer, an end cap is attached to the two opposite ends, at least one threaded hole is defined in each end cap, at least one through hole is defined in the first end of the external rod to align with a corresponding one of the threaded holes in the end cap and at least one hole is defined in the base to align with a corresponding one of the through holes in the external rod, and a second bolt screwed into the threaded hole in the end cap after extending through the hole in the base and the through hole of the external rod to securely mount the horizontal stabilizer in the base.

* * * * *